US006524781B2

(12) United States Patent
Wada

(10) Patent No.: US 6,524,781 B2
(45) Date of Patent: Feb. 25, 2003

(54) PHOTOTHERMOGRAPHIC MATERIAL

(75) Inventor: Yasunori Wada, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/878,871

(22) Filed: Jun. 11, 2001

(65) Prior Publication Data

US 2002/0012888 A1 Jan. 31, 2002

(30) Foreign Application Priority Data

Jun. 15, 2000 (JP) ..... 2000-179807

(51) Int. Cl.[7] ..... G03C 1/498; G03C 1/76

(52) U.S. Cl. ..... 430/523; 430/531; 430/536; 430/619; 430/961; 430/965

(58) Field of Search ..... 430/619, 961, 430/965, 523, 531, 536

(56) References Cited

U.S. PATENT DOCUMENTS 4,490,460 A * 12/1984 Shimba et al. ..... 430/504
5,469,238 A * 11/1995 Biegler ..... 354/300
5,558,972 A * 9/1996 Van Damme et al. ..... 430/200
6,146,822 A * 11/2000 Asanoma et al. ..... 430/965
6,352,819 B1 * 3/2002 Kenney et al. ..... 430/619

* cited by examiner

*Primary Examiner*—Richard L. Schilling
(74) *Attorney, Agent, or Firm*—Bierman, Muserlian and Lucas

(57) ABSTRACT

A photothermographic material is disclosed, comprising a support provide thereon an image forming layer containing a light sensitive silver halide, an organic silver salt and a reducing agent and at least a component a layer, wherein the component layer contains a compound capable of trapping a material causing odor and is provided farther from the support than image forming layer.

16 Claims, No Drawings

PHOTOTHERMOGRAPHIC MATERIAL

FIELD OF THE INVENTION the present invention relates to photothermographic material and an image forming method by the use thereof.

BACKGROUND OF THE INVENTION

It has been known to provide a protective layer on an image forming layer of a photothermographic material. The photothermographic material employs the fact that the image forming layer softens upon heating, enhancing mobility of imaging constituents to promote development. However, problems occur in that the image forming layer which has been soften on heating easily adheres onto the thermal processing drum, often causing image defects, so that a protective layer is required to minimize this.

Further, when subjecting the photothermographic material to thermal processing, odor is caused upon heating, making for worsened environment and it is therefore known to provide a deodorizing apparatus in the thermal processor. One of the causes of the odor is known to be attributed to an aldehyde adduct to alcohol, as described in U.S. Pat. No. 5,469,238. However, there has been no idea of providing a function for positive prevention of the odor from the image forming layer.

In the protective layer of the photothermographic material, coated by using solvents mainly containing water, gelatin has been used but an amino group contained in the gelatin has not been known to have a more or less deodorizing action. Further, although there are known incorporation of a benztriazole compound as an antifoggant into the protective layer of a photographic material, nothing has been known with respect to a deodorizing function of the benztriazole compound. It was also confirmed, by the inventors of this invention, that the benztriazole compound in an amount commonly known in the art exhibited substantially no deodorizing effect.

SUMMARY OF THE INVENTION

In view of the foregoing, the present invention was achieved. Thus, it is an object of the present invention to provide a photothermographic material which one which exhibits superior characteristics including sensitivity and fogging, and an image forming method by the use of the same.

The object of the invention can be accomplished by the following constitution:

(1) A photothermographic material comprising on a support an image forming layer containing a light sensitive silver halide, an organic silver salt and a reducing agent, wherein a layer containing a compound capable of trapping a material causing odor is provided on the image forming layer;

(2) A photothermographic material comprising on a support an image forming layer containing a light sensitive silver halide, an organic silver salt and a reducing agent, wherein a layer containing a compound capable of trapping a material causing odor is provided between the image forming layer and a protective layer;

(3) A photothermographic material comprising on a support an image forming layer containing a light sensitive silver halide, an organic silver salt and a reducing agent, wherein a protective layer, a layer containing a compound capable of trapping a material causing odor and the image forming layer are provided in this order from the outermost layer side, an interlayer is provided between the protective layer and the layer containing a compound capable of trapping a material causing odor, or between the layer containing a compound capable of trapping a material causing odor and the image forming layer;

(4) The photothermographic material described in any one of (1) through (3), wherein the material causing odor is an aldehyde compound or its alcohol adduct, or a carbonyl compound such as an organic acid; and the compound capable of trapping a material causing odor being a compound capable of undergoing nucleophilic addition;

(5) The photothermographic material described in any one of (1) through (4), wherein the compound capable of trapping a material causing odor is contained in an amount of not less than 0.2 $g/m^2$;

(6) An image forming method, wherein the photothermographic material described in any one of (1) through (5) is subjected to a thermal processing.

DETAILED DESCRIPTION OF THE INVENTION

Photothermographic Material

The photothermographic material according to this invention is characterized in that a layer containing a compound capable of trapping a material causing odor (hereinafter, also denoted as an odor trapping compound) is provided on the image forming layer (hereinafter, also denoted as a light sensitive layer).

The photothermographic material of this invention comprises, on the support, basically a light sensitive layer and a protective layer. The odor trapping compound may be contained in the protective layer or a layer containing the odor trapping compound may be provided between the protective layer and the light sensitive layer. In this case, an adhesion-enhancing layer may be provided between these layers to enhance adhesion property of each layer. In cases where the odor trapping compound adversely affects image formation, it is preferred to provide a diffusion-proofing layer between the layer containing the odor trapping compound and the light sensitive layer. A sublayer may be provided between the light sensitive layer and the support to enhance adhesion properties of both layers, a backing layer may be coated on the back side of the support, and the light sensitive layer may be comprised of single layer or plural layers. Odor causing material In this invention, materials causing odor include, for example, aldehydes such as formaldehyde, acetoaldehyde and butylaldehyde, and their alcohol adducts; and carbonyl compounds such as formic acid and oxalic acid, which are usually toxic to the human body and cause pungent odor, deteriorating sanitary of surroundings. Specifically, materials causing odor are aldehydes evaporating from the photothermographic film, such as lower aldehyde compounds, generally having a molecular weight of 30 to 300.

Odor Trapping Ccompound

Odor trapping compounds used in this invention are those capable of undergoing nucleophilic addition to the compounds causing odor described above, and preferably those which contain an —NH— bond in the molecule. Of the compounds containing the —NH— bond in the molecule, specifically, compounds containing an amino bond, a urea bond, an amido bond or an imido bond are preferred. Examples of the compound containing an amino bond include hexamethylenediamine, morpholine, 2-amino-4,5-dicyanoimidazole, 3-azahexane-1,6-diamine, 2-acrylamido-2-methylpropanesulfonic acid, α-amino-caprolactam, acetoguanamine, guanine, acetoaldehyde ammonia, 4,7-diazadecane-1,10-diamine, pyrrolidine, piperidine, piperazine, polyethyleneimine, polyarylamine, polyvinylamine, and polyaniline. Examples of the compound containing a urea bond include uera, ethylurea, dimethylurea, diethylurea, ethyleneurea, guanylurea, guanylthiourea, azodicarbonamide, glycolylurea, and acetylurea. Examples of the compound containing an amido bond include formamide, acetoamide, benzamide, oxamide, oxamic acid, succinic acid amide, and malonamide. Examples of the compound containing an imido bond include succiimide, phthalimide, maleimide, 1-methylol-5,5-dimethylhydantoin, allantoin compound, isocyanuric acid, azole compounds, azine compounds, and pyridazine compounds.

The azole compounds include a diazole compound, triazole compound, and thiadiazole compound. Of these are preferred the diazole compound and triazole compound. Examples of the diazole compound include pyrazolone compounds such as 3-methyl-5-pyrazolone, 1,3-dimethyl-5-pyrazolone3-methyl-1-phenyl-5-pyrazolone, 3-phenyl-6-pyrazolone and 3-methyl-1-(3-sulfophenyl)-5-pyrazolone; and pyrazolo compounds such as pyrazolo, 3-methylpyrazole, 1,4-dimethylpyrazole, 3,5-dimethylpyrazole, 3,5-dimethyl-1-phenylpyrazole, 3-aminopyrazole, 5-amino-3-methylpyrazole, 3-methylpyrazole-5-carboxylic acid, 3-methylpyrazole-5-carboxylic acid methyl ester, 3-methylpyrazole-5-carboxylic acid ethyl ester,3,5-methylpyrazoledicarboxylic acid. Examples of the triazole compound include 1,2,3-triazole, 1,2,4-triazole, 3-n-butyl-1,2,4-triazole, 3,5-dimethyl-1,2,4-triazole, 3,5-di-n-butyl-1,2,4-triazole, 3-mercapto-1,2,4-triazole, 3-amino-1,2,4-triazole, 4-amino-1,2,4-triazole, 3,5-diamino-1,2,4-triazole, 5-amino-3-mercapto-1,2,4-triazole, 3-amino-5-phenyl-1,2,4-triazole, 3,5-diphenyl-1,2,4-triazole, 1,2,4-triazole-3-one, urazole(3,5-dioxy-1,2,4-triazole), 1,2,4-triazole-3-carboxylic acid, and 5-hydroxy-7-methyl-1,3,8-triazaindolidine. Of these, azole compounds are preferred and of the azole compounds, triazole compounds such as 1,2,4-triazole and 1,2,3-triazole; pyrazolo compounds such as 3,5-dimethylpyrazole; and pyrazolone compounds such as 3-methyl-5-pyrazolone are specifically preferred.

Examples of the thiadiazole compound include 2-amino-5-ethyl-1,3,4-thiadizole, 5-amino-2-mercapto-1,3,4-thiadiazole, 2,5-dimercapto-1,3,4-thiadiazole, 5-t-butyl-2-methylaminol,3,4-thiadiazole, 2-amino-5-methyl-13,4-thiadiazole, and 2-amino-1,3,4-thiadiazole.

The azine compounds include, for example, a diazine compound, triazine compound and pyrydazine compounds, and of these is preferred the pyridazine compound. In this case, phthalazines are not included in the foregoing azine compounds.

Examples of the diazine compound include 1,3-diazine compounds such as 1,3-diazine, 2-amino-4,6-dimethyl-1,3-diazine, 4,6-dihydoxy-1,3-diazine, 2-mercapto-1,3-diazine, 2-amino-1,3-diazine, 2,4-dihydoxy-1,3-diazine; and 1,4-diazine compounds such as 2-amino-1,4-diazine, 2,3-dimethyl-1,4-diazine, 2-methyl-1,4-diazine, 1,4-diazine-2-carboxylic acid, and 2,3,5-trimethyl-1,4-diazine. Examples of the triazine compound include 3-amino-5,6-dimethyl-1,2,4-triazine, 3-hydroxy-5,6-diphenyl-1,2,4-triazine, benzo-1,2,3-triazine-4(3H)-one, and 3-(2-pyridyl)-5,6-diphenyl-1,2,4-triazine. Examples of the pyridazine include pyridazine, 6-methyl-8-hydroxytriazolopyridazine, 4,5-dichloro-3-pyridazine and 6-methyl-3-pyridazine.

Examples of 1-aminopyrrolidine compounds include 1-aminopyrrolidine and its inorganic salts. Inorganic salts of 1-aminopyrrolidine compound include a hydrochloride, sulfate, phosphate and carbonate of a 1-aminopyrrolidine compound.

The foregoing odor trapping compound may be included in the form of a side chain or main chain of the binder structure described later. Allowing the odor trapping compound to be included in the side chain or main chain of the binder structure is preferred in terms of minimizing the influence on photographic performance of the photothermographic material and preventing bleeding of the compound. Such polymers usable in the invention include, for example, a polymer containing —NH— bond in the main chain, such as polyamides and a polyvinyl alcohol or polyester containing the above-mentioned compounds of the invention in the side chain. Specifically, a polyacrylamide having a number-average molecular weight of 1,000 to 100,000 is preferred.

Addition of the odor trapping compound is the more, prevention of the objective odor is the more effective, but the addition amount is limited by the influence on photographic performance, bleeding of the compound and odor of the added compound itself. The addition amount is preferably 0.2 to 5 g per $m^2$ of the photothermographic material (also denoted as $g/m^2$) and more preferably 0.5 to 2 $g/m^2$. In the case of being contained in the form of a side chain or main chain of a polymer, the amount is preferably 0.2 to 20 $g/m^2$, and more preferably 1 to 10 $g/m^2$.

The layer containing the odor-trapping compound (or odor trapping layer) desirably has no influence on activity of the order trapping compound. Accordingly, it is necessitated that the binder constituting the odor trapping layer does not contain a carboxylic acid or aldehyde group exceeding the odor-trapping capability of the odor tapping layer.

Light Sensitive Layer

The light sensitive layer (or image forming layer) of photothermographic materials used in this invention contains a light sensitive silver halide, a metal complex, a sensitizer, a stabilizer, an organic silver salt, a reducing agent, an image toning agent and a binder. Binders used in the odor-trapping layer is preferably polyvinyl alcohols, cellulose, polystyrene or polybutadiene, in terms of capability of containing relatively large amounts of the odor trapping compound.

Light Sensitive Silver Halide

Light sensitive silver halide contained in the photothermographic material of the invention function as a photosensor. To prevent milky white after image formation and to obtain superior image quality, smaller grains are preferred, and the average grain size is preferably not more than 0.1 μm, more preferably 0.01 to 0.1 μm, and still more preferably 0.02 to 0.08 μm. The grain size refers to a diameter of a circle having the same area of the grain observed by an electron microscope (i.e., equivalent circle diameter). Furthermore, light sensitive silver halide is preferably monodisperse grains. The monodisperse grains as described herein refer to grains having a coefficient of variation of grain size obtained by the formula described below of not more than 40%; more preferably not more than 30%, and still more preferably not more than 20%.

Coefficient of variation of grain size distribution= (standard deviation of grain diameter)/(average grain diameter)×100(%)

The form of silver halide grains is not specifically limited, but the proportion accounted for by miller index {100} face is preferably high, more preferably not less than 50%, still more preferably not less than 70%, and optimally not less than 80%. The proportion of {100} face can be determined by the method described in T. Tani, J. Imaging Sci., 29, 165 (1985), in which difference in adsorption of sensitizing dyes between {111} face and {100} face was employed.

Another preferred form of the light silver halide is tabular grains. The tabular grain refers to the grain exhibiting an aspect ratio (=r/h) of 3 or more, in which r ($\mu$m) is a diameter represented by a root of the grain projected area and h is a vertical thickness. The aspect ratio is preferably 3 to 50, and the grain diameter is preferably not more than 0.1 $\mu$m, and more preferably 0.01 to 0.08. Such tabular grains are described in U.S. Pat. Nos. 5,264,337, 5,314,798 and 5,320,958, and intended tabular grains can be readily obtained.

The halide composition of silver halide is not specifically limited and may be any one of silver chloride, silver chlorobromide, silver iodochlorobromide, silver bromide, silver iodobromide and silver iodide. Silver halide emulsions used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Any one of acidic precipitation, neutral precipitation and ammoniacal precipitation is applicable and the reaction mode of aqueous soluble silver salt and halide salt includes single jet addition, double jet addition and a combination thereof.

Metal Complex

Silver halide used in this invention preferably occludes ions of metals belonging to Groups 6 to 11 of the Periodic Table. Preferred as the metals are W; Fe, Co, Ni, Cu, Ru, Rh, Pd, Re, Os, Ir, Pt and Au. In the foregoing metal complexes, six-coordinate complexes represented by the general formula described below are preferred:

Formula: $(ML_6)^m$:

wherein M represents a transition metal selected from elements in Groups 6 to 11 of the Periodic Table; L represents a coordinating ligand; and m represents 0, 1-, 2-, 3- or 4-. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different. Particularly preferred examples of M include rhodium (Rh), ruthenium (Ru), rhenium (Re), iridium (Ir) and osmium (Os).

Exemplary examples of metal ion complexes are shown below.

1: $[RhCl_6]^{3-}$
2: $[RuCl_6]^{3-}$
3: $[ReCl_6]^{3-}$
4: $[RuBr_6]^{3-}$
5: $[OsCl_6]^{3-}$
6: $[IrCl_6]^{4-}$
7: $[Ru(NO)Cl_5]^{2-}$
8: $[RuBr_4(H_2O)]^{2-}$
9: $[Ru(NO)\ (H_2O)Cl_4]^{-}$
10: $[RhCl_5(H_2O)]^{2-}$
11: $[Re(NO)Cl_5]^{2-}$
12: $[Re(NO)(CN)_5]^{2-}$
13: $[Re(NO)Cl(CN)_4]^{2-}$
14: $[Rh(NO)_2Cl_4]^{-}$
15: $[Rh(NO)\ (H_2O)Cl_4]-$
16: $[Ru(NO)(CN)_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^{-}$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$
27: $[Ir(NS)Cl_5]^{2-}$

One type of these metal ions or complex ions may be employed and the same type of metals or the different type of metals may be employed in combinations of two or more types. Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole. Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are more preferably added during the stage of nuclei formation.

These compounds may be added several times by dividing the addition amount. Uniform content in the interior of a silver halide grain can be carried out. As disclosed in JP-A No. 63-29603, 2-306236, 3-167545, 4-76534, 6-110146, 5-273683, the metal can be non-uniformly occluded in the interior of the grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening

Desalting

Silver halide grain emulsions used in the invention may be desalted after the grain formation, using the methods known in the art, such as the noodle washing method and flocculation process.

Chemical Sensitizer

Light sensitive silver halide used in this invention preferably chemically sensitized. Preferred chemical sensitization, as is known in the art, include, for example, sulfur sensitization, selenium sensitization, and tellurium sensitization. Further, noble metal sensitization by the use of gold compounds and platinum, palladium, or iridium compounds and reduction sensitization are also applicable.

There can be employed compounds commonly known as preferred compound used for sulfur sensitization, selenium sensitization and tellurium sensitization. Examples of tellurium sensitizers include diacyltellurides, bis(oxycarbonyl) tellurides, bis(carbamoyl)tellurides, diacyltellyrides, bis (oxycarbonyl)ditellurides, bis(carbamoyl)ditellurides, compounds containing a P=Te bond, tellurocarboxylates, Te-organyltellurocarboxylic acid esters, di(or poly) tellurides, tellurides, tellulols, telluloacetals, tellulosulfonates, compounds containing a P—Te bond, Te-containing heterocyclic compounds, tellurocarbonyl compounds, inorganic tellurium compounds and colloidal tellurium compounds. Examples of compounds used for noble metal sensitization include chloroauric acid, potassium chloroaurate, potassium aurithiocyanate, gold sulfide, gold selenide and compounds described in U.S. Pat. No. 2,448,060 and British patent No. 618,061. Examples of compounds used for reduction sensitization include stannous chloride, aminoiminomethanesulfinic acid, hydrazine derivatives, borane compounds, silane compounds, and polyamine compounds as well as ascorbic acid and thiourea dioxide. Reduction sensitization can also conducted by ripening the emulsion while maintaining a pH higher than 7 or a pAg lower than 8.3. Further, reduction sensitization is undergone by introduction a part of a single addition of silver ions during grain formation.

Sensitizing dyes are applicable to the light-sensitive layer of photothermographic materials used in this invention, including those which are described in JP-A 63-159841, 60-140335, 63-231437, 63-259651, 63-304242, 63-15245; U.S. Pat. Nos. 4,639,414, 4,740,455, 4,741,966, 4,751,175 and 4,835,096. Further, sensitizing dyes usable in this invention are described in Research Disclosure item 17643, IV-A, page 23 (December, 1978) and references cited therein. Sensitizing dyes exhibiting spectral sensitivity specifically suitable for spectral characteristics of various scanner light sources can be advantageously selected. There can be selected, for example, simple merocyanines described in JP-A No. 60-162247 and 2-48635, U.S. Pat. No. 2,161,331, German Patent No. 936,071, and Japanese Patent Application No. 3-189532, which are suitable for an argon ion laser light source; three-nuclei cyanine dyes described in JP-A No. 50-62425, 54-18726, 59-102229 and merocyanine dyes described in Japanese Patent Application No. 6-103272, which are suitable for a helium-neon laser light source; thiacarbocyanine dyes described in JP-B No. 48-42172, 51-9609, 55-39818 (hereinafter, the term, JP-B refers to published Japanese Patent), JP-A No. 62-284343 and 2-105135, which are suitable for LED light source and infrared semiconductor laser light source; tricarbocyanine dyes described in JP-A No. 59-191032 and 60-80841 and 4-quinoline nucleus-containing dicarbocyanine dyes described in JP-A 59-192242 and 3-67242 [formulas (IIIa) and (IIIb)], which are suitable for an infrared semiconductor laser light source. Further, sensitizing dyes described in JP-A No. 4-182639, 5-341432, JP-B No. 6-52387, 3-10931, U.S. Pat. No. 5,441,866 and JP-A 7-13295 are also employed to respond to infrared laser light of not less than 750 nm, preferably not less than 800 nm. These sensitizing dyes may be used alone or in combination thereof. The combined use of sensitizing dyes is often employed for the purpose of supersensitization. A super-sensitizing compound, such as a dye which does not exhibit spectral sensitization or substance which does not substantially absorb visible light may be incorporated, in combination with a sensitizing dye, into the emulsion. Useful sensitizing dyes, dye combinations exhibiting super-sensitization and materials exhibiting supersensitization are described in RD17643 (published in December, 1978), IV-J at page 23, JP-B 9-25500 and 43-4933 (herein, the term, JP-B means published Japanese Patent) and JP-A 59-19032, 59-192242 and 5-341432.

In the invention, an aromatic heterocyclic mercapto compound represented by the following formula (M) is preferred as a supersensitizer:

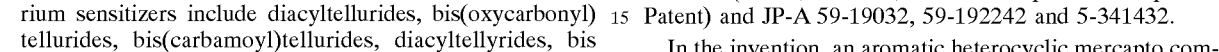

Ar—SM Formula (M)

wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. Other aromatic heterocyclic rings may also be included.

A disulfide compound which is capable of forming a mercapto compound when incorporated into a dispersion of an organic silver salt and/or a silver halide grain emulsion is also included in the invention. In particular, a preferred example thereof is a disulfide compound represented by the following formula:

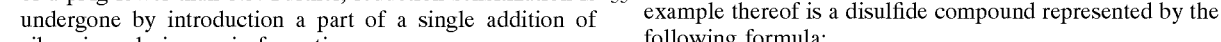

Ar—S—S—Ar Formula (Ma)

wherein Ar is the same as defined in formula (M). The aromatic heterocyclic rings described above may be substituted with a halogen atom (e.g., Cl, Br, I), a hydroxy group, an amino group, a carboxy group, an alkyl group (having one or more carbon atoms, and preferably to 4 carbon atoms) or an alkoxy group (having one or more carbon atoms, and preferably to 4 carbon atoms). Exemplary examples of mercapto-substituted aromatic heterocyclic compound are shown below but are not limited to these.

M-1: 2-mercaptobenzimidazole
M-2: 2-mercaptobenzoxazole
M-3: 2-mercaptobenzthiazole
M-4: 5-methyl-2-mercaptobenzimidazole
M-5: 6-ethoxy-2-mercaptobenzthiazole
M-6: 2,2'-dithiobis(benzthiazole)
M-7: 3-mercapto-1,2,4-triazole
M-8: 4,5-diphenyl-2-imidazole
M-9: 2-mercaptoimidazole
M-10: 1-ethyl-2-mercaptobenzimidazole
M-11: 2-mercaptoquinoline
M-12: 8-mercaptopurine
M-13: 2-mercapto-4(3H)-quinazoline
M-14: 7-trifluoromethyl-4-quinolinethiol
M-15: 2,3,5,6-tetrachloro-4-pyridinethiol
M-16: 4-amino-6-hydroxy-2-mercaptopyridine monohydrate
M-17: 2-amino-5-mercapto-1,3,4-thiazole
M-18: 3-amino-5-mercapto-1,2,4-triazole M-19: 4-hydroxy-2-mercaptopyridine
M-20: 2-mercaptopyridine
M-21: 4,6-diamino-2-mercaptopyridine
M-22: 2-mercapto-4-methylpyrimidine hydrochloride
M-23: 3-mercapto-5-phenyl-1,2,4-riazole
M-24: 2-mercapto-4-phenyloxazole Thiuronium compounds represented by the following formula (1) can also preferably be employed as a supersensitizer:

Formula (1)

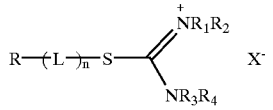

wherein R represents a substituted or unsubstituted aryl group or alkyl group, and preferably a substituted or unsubstituted, heteroatom containing aromatic group; $R_1$, $R_2$, $R_3$ and $R_4$ each represent independently a hydrogen atom, or a substituted or unsubstituted aryl group or alkyl group; L represents a linkage group, and preferably an alkylene group having 1 to 10 carbon atoms; n is 0 or 1; and X represents a halogen atom.

The supersensitizer compound usable in this invention is incorporated into an emulsion layer containing the organic silver salt and light sensitive silver halide, preferably in an amount of 0.001 to 1.0 mol, and more preferably 0.01 to 0.5 mo per mol of silver.

Stabilizer

Heteroatom containing macrocyclic compounds may be incorporated in the light sensitive layer of he photothermographic material to improve photographic characteristics such as sensitivity and fog. The macrocyclic compound is preferably a 9 or more membered ring (more preferably 12- to 24-membered ring, and still more preferably 15- to 21-membered ring) containing at least a heteroatom selected from nitrogen oxygen, sulfur and selenium atoms. Representative compounds thereof include compounds commonly known as a crown ether, which was synthesized by Pederson in 1967 and a number of which have been synthesized since its specific report. The compounds are detailed in C. J. Pederson, Journal of American Chemical Society vol. 86 (2495), 7017–7036 (1967); G. W. Gokel & S. H. Korzeniowski, "Macrocyclic Polyether Synthesis", Springer-Vergal (1982); "Chemistry of Crown Ether" edited by Oda, Shono & Tabuse, published by Kyoritsu Shuppan (1978); "Host-Guest" edited by Tabuse, published by Kyoritsu Shuppan (1979); and Suzuki & Koga, Yuki Gosei Kagaku (Journal of Organic Synthetic Chemistry) vol. 45 (6) 571–582 (1987).

Organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidinic acid and stearic acid are specifically preferred.

The organic silver salt compound can be obtained by mixing an aqueous-soluble silver compound with a compound capable of forming a complex. Normal precipitation, reverse precipitation, double jet precipitation and controlled double jet precipitation described in JP-A 9-127643 are preferably employed. For example, to an organic acid is added an alkali metal hydroxide (e.g., sodium hydroxide, potassium hydroxide, etc.) to form an alkali metal salt soap of the organic acid (e.g., sodium behenate, sodium arachidinate, etc.), thereafter, the soap and silver nitrate are mixed by the controlled double jet method to form organic silver salt crystals. In this case, silver halide grains may be concurrently present.

In the present invention, organic silver salts have an average grain diameter of 2 $\mu$m or less and are monodisperse. The average diameter of the organic silver salt as described herein is, when the grain of the organic salt is, for example, a spherical, cylindrical, or tabular grain, a diameter of the sphere having the same volume as each of these grains. The average grain diameter is preferably between 0.05 and 1.5 $\mu$m, and more preferably between 0.05 and 1.0 $\mu$m. Furthermore, the monodisperse as described herein is the same as silver halide grains and preferred monodispersibility is between 1 and 30%.

It is also preferred that at least 60% of the total of the organic silver salt is accounted for by tabular grains. The tabular grains refer to grains having a ratio of an average grain diameter to grain thickness, i.e., aspect ratio (denoted as AR) of 3 or more:

$$AR = \text{average diameter } (\mu m)/\text{thickness } (\mu m)$$

To obtain such tabular organic silver salts, organic silver salt crystals are pulverized together with a binder or surfactant, using a ball mill. Thus, using these tabular grains, photosensitive materials exhibiting high density and superior image fastness are obtained.

To prevent hazing of the photosensitive material, the total amount of silver halide and organic silver salt is preferably 0.5 to 2.2 g in equivalent converted to silver per $m^2$, thereby leading to high contrast images. The amount of silver halide is preferably not more than 50%, more preferably not more than 25%, and still more preferably 0.1 to 15% by weight, based on total silver.

Reducing Agent

Commonly known reducing agents are used in the photothermographic materials, including phenols, polyphenols having two or more phenols, naphthols, bisnaphthols, polyhydoxybenzenes having two or more hydroxy groups, polyhydoxynaphthalenes having two or more hydroxy groups, ascorbic acids, 3-pyrazolidones, pyrazoline-5-ones, pyrazolines, phenylenediamines, hydroxyamines, hydroquinone monoethers, hydrooxamic acids, hydrazides, amidooximes, and N-hydroxyureas. Further, exemplary examples thereof are described in U.S. Pat. Nos. 3,615,533, 3,679,426, 3,672,904, 3,51,252, 3,782,949, 3,801,321, 3,794,488, 3,893,863, 3,887,376, 3,770,448, 3,819,382, 3,773,512, 3,839,048, 3,887,378, 4,009,039, and 4,021,240; British Patent 1,486,148; Belgian Patent 786,086; JP-A 50-36143, 50-36110, 50-116023, 50-99719, 50-140113, 51-51933, 51-23721, 52-84727; and JP-B 51-35851. An optimal reducing agent can be selected from these reducing agents.

Of these reducing agents, in cases where fatty acid silver salts are used as an organic silver salt, preferred reducing agents are polyphenols in which two or more phenols are linked through an alkylene group or a sulfur atom, specifically, polyphenols in which two or more phenols are linked through an alkylene group or a sulfur atom and the phenol(s) are substituted at least a position adjacent to a hydroxy group by an alkyl group (e.g., methyl, ethyl, propyl, t-butyl, cyclohexyl) or an acyl group (e.g., acetyl, propionyl). Examples thereof include polyphenols compounds such as 1,1-bis(2-hydroxy-3,5-dimethylphenyl)-3,5,5-trimethylhexane, 1,1-bis(2-hydroxy-3-t-butyl-5-methyphenyl)methane, 1,1-bis(2-hydroxy-3,5-di-t-butylphenyl)methane, 2-hydroxy-3-t-butyl-5-methylphenyl)-(2-hydroxy-5-methylphenyl)methane, 6,6'-benzylidene-bis(2,4-di-t-butylphenol), 6,6'-benzylidene-bis(2-t-butyl-4-methylphenol), 6,6'-benzylidene-bis(2,4-dimethylphenol), 1,1-bis(2-hydroxy-3,5-dimethylphenyl)-2-methylpropane, 1,1,5,5-tetrakis(2-hydroxy-3,5-dimethylphenyl)-2,4-ethylpentane, 2,2-bis(4-hydroxy-3,5-dimethylphenyl)propane, 2,2-bis(4-hydroxy-3,5-di-t-butylphenyl)propane, as described in U.S. Pat. Nos. 3,589,903 and 4,021,249, British Patent 1,486,148, JP-A 51-51933, 50-36110 and 52-84727 and JP-B 51-35727; bisnaphthols described in U.S. Pat. No. 3,672,904, such as 2,2' dihydoxy-1,1'-binaphthyl, 6,6'-dibromo-2,2'-dihydroxy-1,1'-binaphthyl, 6,6'-dinitro-2,2'-dihydroxy-1,1'-binaphtyl, bis(2-hydroxy-1-naphthyl)methane, 4,4'-dimethoxy-1,1'-dihydroxy-2,2'-binaphthyl; sulfonamidophenols or sulfonamidonaphthols described in U.S. Pat. No. 3,801,321, such as 4-benzene-sulfonamidophenol, 2-benzenesulfonamidophenol, 2,6-dichloro-4-benzenesulfonamidophenol and 4-benzenesulfonamidonaphthol.

The amount of the reducing agent used in the photothermographic material, depending on an organic silver salt, the kind of a reducing agent and other additives, is preferably 0.05 to 10 mol, and more preferably 0.1 to 3 mol per mol of organic silver salt. Plural reducing agents may be used in combination in an amount meeting the foregoing range.

Toning Agent

The photothermographic material preferably contains, in addition to the foregoing components, an additive, which is called an image toning agent, color tone providing agent or activator toner (hereinafter, called an image toning agent). The image toning agent concerns oxidation-reduction reaction of an organic silver salt with a reducing agent, having a function of increasing color of the formed silver image or making it black. Image toning agents are preferably incorporated into the photothermographic material used in the present invention. Examples of preferred image toning agents are disclosed in Research Disclosure Item 17029, and include the following:

imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides [for example, N-(dimethylaminomethyl)phthalimide]; blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H,4H-2,3a,5,6a-tatraazapentalene). Preferred image color control agents include phthalazone or phthalazine.

Binder

Binders other than the binder used in the formation of organic silver salts. Binders used in the image forming layer are transparent or translucent and generally colorless, including natural polymers, synthetic polymers or copolymers and film forming mediums. Exemplary examples thereof include gum Arabic, polyvinyl alcohol, hydroxyethyl cellulose, cellulose acetate, cellulose acetate butyrate, polyvinyl pyrrolidine, casein, starch, polyacrylic acid, poly(methyl methacrylate), poly(methylmethacrylic acid), polyvinyl chloride, polymethacrylic acid, copoly(styrene-anhydrous maleic acid), copoly(styrene-acrylonitrile), copoly(styrene-butadiene9, polyvinyl acetals (e.g., polyvinyl formal, polyvinyl butyral), polyesters, polyurethanes, phenoxy resin, polyvinylidene chloride, polyepoxides, polycarbonates, polyvinyl acetate, cellulose esters, and polyamides, these of which may be hydrophilic or hydrophobic. Of these binders, water insoluble polymers are preferred such as cellulose acetate, cellulose acetate-butyrate and polyvinyl butyral, and polyvinyl butyral is more preferred. The binder content in the light sensitive layer is preferably 1.5 to 6 g/m$^2$, and more preferably 1.7 to 5 g/m$^2$. The content of less than 1.5 g/m$^2$ often results in an increase in density of the unexposed area to levels unacceptable in practical use. Matting agent In the present invention, a matting agent is preferably incorporated into the image forming layer side. In order to minimize the image abrasion after thermal development, the matting agent is provided on the surface of a photosensitive material and the matting agent is preferably incorporated in an amount of 0.5 to 30 per cent in weight ratio with respect to the total binder in the emulsion layer side. In cases where a non photosensitive layer is provided on the opposite side of the support to the photosensitive layer, it is preferred to incorporate a matting agent into at least one of the non-photosensitive layer (and more preferably, into the surface layer) in an amount of 0.5 to 40% by weight, based on the total binder on the opposite side to the photosensitive layer.

Materials of the matting agents employed in the present invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere having the same volume as the matting agent. The particle diameter of the matting agent in the present invention is referred to the diameter of a spherical converted volume. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50%, is more preferably not more than 40%, and is still more preferably not more than 30%. The variation coefficient of the grain size distribution as described herein is the same as defined in silver halide grains described earlier. The matting agent can be incorporated into any component layer, preferably in a layer other than the light sensitive layer, and more preferably in the outermost layer farthest from the support. Addition methods of the matting agent include those in which a matting agent is previously dispersed into a coating composition and is then coated, and prior to the completion of drying, a matting agent is sprayed. When plural matting agents are added, both methods may be employed in combination.

Interlayer Having Function of Preventing Diffusion

In cases where the odor trapping compound affects the image formation of the light sensitive layer, it is preferred to provide an interlayer having a function of preventing the diffusion of the odor trapping compound, between the light sensitive layer and the layer containing the odor trapping compound. Diffusion of the odor trapping compound into the light sensitive layer often results in troubles, such as increased fogging, reduced sensitivity and deteriorated image storage stability. To prevent such troubles, it is preferred to provide an interlayer having the function of preventing the diffusion of the odor trapping compound, between the light sensitive layer and the layer containing the odor trapping compound. The interlayer having a diffusion-preventing function is a layer exhibiting the characteristic of permitting penetration of odor produced in the light sensitive layer during or after thermal development but preventing transfer from the layer containing the odor trapping compound to the light sensitive layer.

One preferred embodiment of the interlayer having a diffusion-preventing function is to lessen the ability for retaining the odor trapping compound of the interlayer, compared to that of the layer containing the odor trapping compound. The ability for retaining the odor trapping compound is defined as follows. Thus, when forming a resin film layer containing the odor trapping compound, the ability is represented by a limiting value at which the odor trapping compound precipitates on the surface or in the interior of the layer. In other words, the interlayer preferably exhibits a less power for retaining the odor trapping compound, compared to the layer containing the odor trapping compound. The less the ability for retaining the odor trapping compound, the more effectively transfer of the odor trapping compound is prevented. In such a case, it is preferred that the power for retaining the odor trapping compound of the layer containing the odor trapping compound is at least three times larger than that of the interlayer.

In a photothermographic material comprising a light sensitive layer further thereon having a layer containing an odor trapping compound and a polyvinyl alcohol resin as a binder, one method for meeting the condition described above is, for example, providing a diffusion-proof layer containing, as a binder, an acetal resin, cellulose butyrate-acetate resin or phenoxy resin.

Layer Constitution of Photothermographic Material

The photothermographic material comprises at least one light sensitive layer on a support. There is the light sensitive layer alone on the support or there may be further provided at least a light insensitive layer on the light sensitive layer. To control the amount or wavelength distribution of light transmitted to the light sensitive layer, a filter layer may be provided on the light sensitive layer side or on the opposite side, or a dye or pigment may be incorporated in the light sensitive layer. Dyes used therein are preferably compounds described in JP-A 8-201959. The light sensitive layer may be comprised of plural layers, or the combination of high-speed and low-speed light sensitive layers may be provided. Various additives may be incorporated into the light sensitive layer, light insensitive layer or other component layer(s). Examples thereof include a surfactant, antioxidant, stabilizer, plasticizer, UV absorbent and coating aid.

Image Forming Process

Exposure of the photothermographic material is conducted preferably employing argon laser (488 nm), he-ne-laser (633 nm), red semiconductor laser (670 nm), infrared semiconductor laser (780 nm, 820 nm). Of these, infrared semiconductor laser is preferred in terms of being high power and transparent to the photothermographic material.

In the invention, exposure is preferably conducted by laser scanning exposure. It is also preferred to use a laser exposure apparatus, in which a scanning laser light is not exposed at an angle substantially vertical to the exposed surface of the photothermographic material. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photothermographic material is scanned with laser light, the beam spot diameter on the surface of the photosensitive material is preferably not more than 200 μm, and more preferably not more than 100 μm. Thus, a smaller spot diameter preferably reduces the angle displacing from verticality of the laser incident angle. The lower limit of the beam spot diameter is 10 μm. The thus laser scanning exposure can reduce deterioration in image quality due to reflected light, resulting in occurrence such as interference fringe-like unevenness.

Exposure applicable in the invention is conducted preferably using a laser scanning exposure apparatus producing longitudinally multiple scanning laser beams, whereby deterioration in image quality such as occurrence of interference fringe-like unevenness is reduced, as compared to a scanning laser beam of the longitudinally single mode. Longitudinal multiplication can be achieved by a technique of employing backing light with composing waves or a technique of high frequency overlapping. The expression "longitudinally multiple" means that the exposure wavelength is not a single wavelength. The exposure wavelength distribution is usually not less than 5 nm and not more than 10 nm. The upper limit of the exposure wavelength distribution is not specifically limited but is usually about 60 nm.

Photothermographic materials used in this invention are stable at ordinary temperature and are developed upon being heated at a high temperature after exposure. The heating temperature is preferably 80 to 200° C., and more preferably 100 to 150° C. Heating at a temperature lower than 80° C. results in images with insufficient densities and at the heating temperature higher than 200° C., the binder melts, adversely affecting not only images but also transportability and a thermal processor. On heating, oxidation-reduction reaction between an organic silver salt (acting as an oxidant) and a reducing agent is caused to form silver images. This reaction process proceeds without supply of water from the outside.

EXAMPLES

The present invention will be further described based on examples but the invention is by no means limited to these examples.

Example 1

Preparation of Sample 1 (Comp.)

Backing Layer

On one side of a blue-tinted, 175 μm thick polyethylene terephthalate (also denoted as PET) film support exhibiting a blue density 0.17 (measured by densitometer PDA-65, available from Konica Corp.) which was subjected to a corona discharge treatment at 8 $W/m^2 \cdot min$, a coating solution of a backing layer, having the following composition was coated by an extrusion coater so as to form a dry layer thickness of 3.5 μm and dried with dry air at a drying temperature of 100° C. and a dew point of 10° C.

Preparation of Backing Layer Coating Solution

To 830 g of methyl ethyl ketone, 84.2 g of cellulose acetate-butylate (CAB381-20, available from Eastman Chemical Co.) and 4.5 g of polyester resin (Vitel PE2200B, available from Bostic Corp.) were added with stirring and dissolved therein. To the resulting solution was added 0.30 g of infrared dye 1 and 4.5 g fluorinated surfactant (Surflon KH40, available from ASAHI Glass Co. Ltd.) and 2.3 g fluorinated surfactant (Megafag F120K, available from DAINIPPON INK Co. Ltd.), which were dissolved in 43.2 g methanol, were added thereto and stirred until being dissolved. Then, 75 g of silica (Siloid 64X6000, available from W.R. Grace Corp.), which was dispersed in methyl ethyl ketone in a concentration of 1 wt % using a dissolver type homogenizer, was further added thereto with stirring to obtain a coating solution A for backing layer.

Light Sensitive Layer

Preparation of Light-sensitive Silver Halide Emulsion 1

| | |
|---|---|
| Solution A1 | |
| Phenylcarbamoyl gelatin | 88.3 g |
| Compound (A) (10% methanol solution) | 10 ml |
| Potassium bromide | 0.32 g |
| Water to make | 5429 ml |
| Solution B1 | |
| 0.67 mol/l Aqueous silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| Iridium chloride (1% solution) | 0.93 ml |
| Solution E1 | |
| 0.4 mol/l aqueous potassium bromide solution | |
| Amount necessary to adjust silver potential | |
| Solution F1 | |
| Aqueous 56% acetic acid solution | 16 ml |
| Solution G1 | |
| Anhydrous sodium carbonate | 1.72 g |
| Water to make | 151 ml |

Compound (A)

$HO)CH_2CH_2O)_n—(CH(CH_3)CH_2O)_{17}—(CH_2CH_2O)_mH(m+n=5$ to 7)

Using a stirring mixer described in JP-B 58-58288 and 58-58289, ¼ of solution B1, the total amount of solution C1 were added to solution A1 by the double jet addition for 4 min 45 sec. to form nucleus grain, while maintaining a temperature of 45° C. and a pAg of 8.09. After 1 min., the total amount of solution F1 was added thereto. After 7 min, the remainder of solution B1 and the total amount of solution D1 were further added by the double jet addition for 14 min 15 sec., while mainlining a temperature of 45° C. and a pAg of 8.09. After stirring for 5 min., the reaction mixture was lowered to 40° C. and solution G1 was added thereto to coagulate the resulting silver halide emulsion. Remaining 2000 ml of precipitates, the supernatant was removed and after adding 10 lit. water with stirring, the silver halide emulsion was again coagulated. Remaining 1500 ml of precipitates, the supernatant was removed and after adding 10 lit. water with stirring, the silver halide emulsion was again coagulated. Remaining 1500 ml of precipitates, the supernatant was removed and solution G1 was added. The temperature was raised to 60° C. and stirring continued for 120 min. Finally, the pH was adjusted to 5.8 and water was added there to so that the weight per mol of silver was 1161 g, and light-sensitive silver halide emulsion A was thus obtained. It was proved that the resulting emulsion was comprised of monodisperse silver iodobromide cubic grains having an average grain size of 0.058 μm, a coefficient of variation of grain size of 12% and a [100] face ratio of 92%.

Preparation of Powdery Organic Silver Salt

In 4720 ml water were dissolved 111.4 g of behenic acid, 83.8 g of arachidic acid and 54.9 g of stearic acid at 80° C. The, after adding 540.2 ml of 1.5M aqueous sodium hydroxide solution with stirring and further adding 6.9 ml of concentrated nitric acid, the solution was cooled to a temperature of 55° C. to obtain an aqueous organic acid sodium salt solution. To the solution were added the silver halide emulsion (equivalent to 0.038 mol silver) and 450 ml water and stirring further continued for 5 min., while maintained at a temperature of 550° C. Subsequently, 702.6 ml of 1M aqueous silver nitrate solution was added in 2 min. and stirring continued further for 10 min., then, the reaction mixture was filtered to remove aqueous soluble salts. Thereafter, washing with deionized water and filtration were repeated until the filtrate reached a conductivity of 2 μS/cm, and after subjecting to centrifugal dehydration, the reaction product was dried with heated air at 40° C. until no reduction in weight was detected to obtain a powdery organic silver salt.

Preparation of Preliminarily Dispersed Solution

In 1457 g methyl ethyl ketone was dissolved 14.57 g of polyvinyl butyral powder (Butvar B-79, available from Monsanto Corp.) and further thereto, 500 g of the powdery organic silver salt with stirring by dissolver DISPERMAT CA-40M type (available from VMA-GETZMANN Corp.) was gradually added to obtain a preliminary dispersed solution.

Preparation of Emulsifying Dispersion

Using a pressure type homogenizer, Type GM-2 (available from S.T.M. Co.), the preliminary dispersed solution was subjected two-pass dispersion to obtain a light sensitive emulsifying dispersion. The treatment pressure at the first pass was 27.46 MPa and that at the second pass was 54.92 MPa.

The following solutions required for preparing a coating solution of the light sensitive layer were prepared.

| | |
|---|---|
| Stabilizer solution | |
| Stabilizer 1 | 1.00 g |
| Potassium acetate | 0.31 g |
| Methanol | 10 g |
| Infrared sensitizing dye solution | |
| Infrared sensitizing dye 1 | 41.0 mg |
| 2 -Chlorobenzoic acid | 2.0 g |
| MEK | 100 g |
| Addition solution A | |
| 1,1-Bis(2-hydroxy-3,5-dimethylpheny)-3,5,5-trimethylhexane | 51.0 g |
| 4-Methylphthalic acid | 3.40 g |
| Infrared dye 1 | 0.22 g |
| MEK | 170 g |

Infrared dye 1

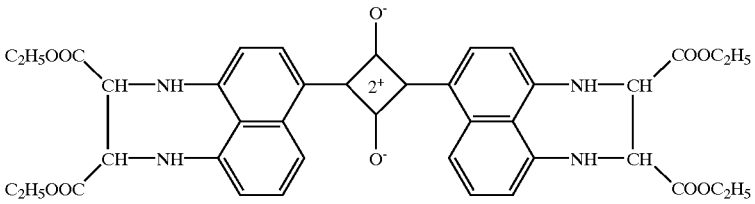

Stabilizer 1

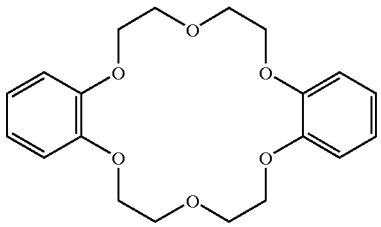

Infrared sensitizing dye 1

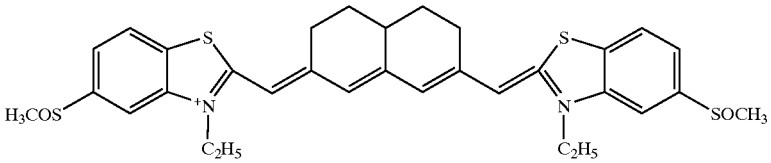

Preparation of Light Sensitive Layer Coating Solution

The light-sensitive emulsion-dispersed solution of 100 g and 45 g MEK were maintained at 25° C. with stirring. Then, 0.65 g of antifoggant 1 solution (10% by weight methanol solution) was added and stirred for 1 hr. and 0.84 g of calcium bromide solution (10% by weight methanol solution) was added and further stirred for 20 min. Subsequently, 0.70 g of the stabilizer solution was further added thereto and after stirring for 10 min., 7.90 g of the infrared sensitizing dye solution was added, stirred for 1 hr. and then, 1.50 g of 1 wt % supersensitizer 1 methanol solution was added. Then, after stirring for 30 min., the reaction mixture was cooled to 13° C. and further stirred for 30 min.

Further, 26 g of polyvinyl butyral (Butvar B-79, available from Monsanto Corp.) was added thereto and after 15 min., 2.3 g of tetrachlorophthalic acid (13% by weight MEK solution) was added and stirred for 15 min. Then, 4.5 g of 22 wt % MEK solution of isocyanate compound IC-10, 27.0 g of addition solution A, and 9.0 g of 10% by weight MEK solution of phthalazinone were successively added with stirring to obtain light sensitive layer coating solution 1.

Antifoggant 1

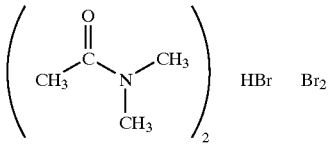

Supersensitizer 1

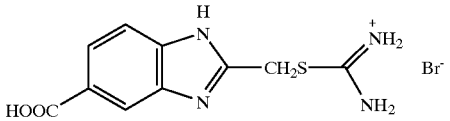

Isocyanate compound IC-10

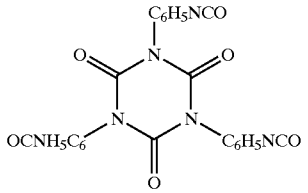

Preparation of Matting Agent Dispersion

Cellulose acetate butyrate (7.5 g of CAB171-15, available from Eastman Chemical Co.) was dissolved in 42.5 g of MEK, then, 5 g of calcium carbonate (Super-Pflex 200, available from Speciality Mineral Corp.) was added thereto and dispersed using a dissolver type homogenizer at 8000 rpm for 30 min to obtain a matting agent dispersion.

Preparation of Protective Layer Coating Solution

To 865 g of methyl ethyl ketone were added with stirring 96 g of cellulose acetate butyrate (CAB171-15, available from Eastman Chemical Co.) and 4.5 g of polymethyl methacrylate (Paraloid A-21, available from Rohm & Haas Corp.). Further thereto were added and dissolved 1.5 g of vinylsulfone compound shown below, 1.0 g of benzotriazole and 1.0 g of fluorinated surfactant (Surflon KH40, available from ASAHI Glass Co. Ltd.). Then, 30 g of the matting agent dispersion was further added thereto to obtain a coating solution of the surface protective layer.

Vinylsulfone compound (HD-1)

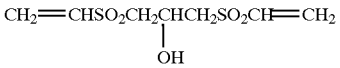

Preparation of Photothermographic Material

The foregoing light sensitive layer coating solution and protective layer coating solution were simultaneously coated using an extrusion coater so as to form a silver coverage of 1.9 g/m$^2$ of the light sensitive layer and a dry layer thickness of 2.5 $\mu$m of the protective layer. Then, coated sample was dried with a dried air at a drying temperature of 75° C. and a dew point of 10° C. for a period of 10 min. to obtain Sample No. 1 (used for comparison).

Samples Nos. 2 through 12 were prepared similarly to Sample No. 1, provided that 10 kinds of odor trapping compounds were each incorporated into the surface protective layer for the light sensitive layer, as shown in Table 1.

Exposure and Thermal Processing

The thus prepared photothermographic material samples Nos. 1 through 12 were each subjected to laser scanning exposure from the emulsion side using an exposure apparatus having a light source of 800 to 820 nm semiconductor laser of a longitudinal multi-mode, which was made by means of high frequency overlapping. In this case, exposure was conducted at 75° C. of an angle between the exposed surface and the exposing laser light. The exposed photothermographic material was subjected to thermal development at 120° C. for 15 sec., while the protective layer surface of the photothermographic material was brought into contact with the heated drum surface.

Processed samples Nos. 1 through 12 were each evaluated with respect to the extent of odor produced during or after thermal development, and sensitivity and fogging. Results thereof are shown in Table 1.

Evaluation of Odor

Odor was measured by 20 persons with respect to the extent of odor produced at the time of thermal development and odor of the at one by one increments, based on the following criteria:

0: No odor,

20: Slightly detectable odor

40: Weak but identifiable odor

60: Easily detectable odor

80: Strong odor

100: Markedly strong odor.

Evaluation of Sensitivity

The transmission image density of each sample was measured to evaluate silver image tone (or image color and also denoted as "Ton" in the Table) and a fog density (also denoted as Fog). The image tone was evaluated in the following manner. Thus, an imaging area exhibiting a density measured with amber light of 1.0 was measured with respect to density measured with a blue light, using a densitometer (PDA 62, available from Konica Corp.). This value closer to 1.0 indicates superior image tone. Thus, the closer to 1.0, the more preferred image tone, closing to blue black tone.

TABLE 1

| Sample No. | Odor Trapping Compd. (g/m$^2$) | Odor | Tone | F | Remark |
|---|---|---|---|---|---|
| 1 | — | 82 | 0.85 | 0.25 | Comp. |
| 2 | 2-acrylamido-2-methylsulfonic acid (2) | 32 | 0.92 | 0.2 | Inv. |
| 3 | glycolyl urea (2) | 55 | 0.93 | 0.2 | Inv. |
| 4 | succinamide (2) | 73 | 0.95 | 0.21 | Inv. |
| 5 | 5-dimethylhydatoin (2) | 37 | 0.93 | 0.19 | Inv. |
| 6 | allantoin (2) | 32 | 0.92 | 0.19 | Inv. |
| 7 | isocyanuric acid (2) | 53 | 0.96 | 0.2 | Inv. |
| 8 | 3,5-dimethyl-1-phenylpyrazole (2) | 51 | 0.92 | 0.2 | Inv. |
| 9 | 5-methylbenztriazole (2) | 45 | 0.92 | 0.19 | Inv. |
| 11 | 3-amino-5,6-dimethyl-1,2,4-triazine (2) | 37 | 0.95 | 0.19 | Inv. |
| 12 | 6-methyl-8-hydroxytriazolopyridazine (2) | 50 | 0.96 | 0.2 | Inv. |

As can be seen from Table 1, inventive samples Nos. 2 to 9, 11 and 12 exhibited little odor during and after thermal development and superior results of image tone and fog density. It was also proved that comparative sample No 1 exhibited marked odor produced during and after thermal development, leading to inferior results in either image tone of fog density.

Example 2

Samples Nos. 14 through 21, 23 and 24 (Inv.) and Samples No 13 (Comp.) were prepared similarly to Sample No. 1 of Example 1, provided that on the light sensitive layer, a 0.5 $\mu$m thick, cellulose acetate-butyrate resin layer was provided as a diffusion-proof layer; further thereon, 0.2 $\mu$m thick layer containing a odor trapping compound as shown in Table 2; and a 2.5 $\mu$m thick, protective layer similar to sample No. 1 was provided as the uppermost layer.

TABLE 2

| Sample No. | Odor Trapping Compd. (g/m$^2$) | Odor | Tone | F | Remark |
|---|---|---|---|---|---|
| 13 | — | | 0.85 | 100 | Comp. |
| 14 | 2-acrylamido-2-methylsulfonic acid (2) | 2 | 0.92 | 92 | Inv. |
| 15 | glycolyl urea (2) | 2 | 0.93 | 91 | Inv. |
| 16 | succinamide (2) | 2 | 0.95 | 95 | Inv. |
| 17 | 5-dimethylhydatoin(2) | 2 | 0.93 | 92 | Inv. |
| 18 | allantoin (2) | 2 | 0.92 | 90 | Inv. |
| 19 | isocyanuric acid (2) | 2 | 0.92 | 93 | Inv. |
| 20 | 3,5-dimethyl-1-phenylpyrazole (2) | 2 | 0.96 | 95 | Inv. |
| 21 | 5-methylbenztriazole (2) | 2 | 0.92 | 91 | Inv. |
| 23 | 3-amino-5,6-dimethyl-1,2,4-triazine (2) | 2 | 0.95 | 94 | Inv. |
| 24 | 6-methyl-8-hydroxytriazolopyridazine (2) | 2 | 0.96 | 96 | Inv. |

As can be seen from Table 2, inventive samples Nos. 14 to 21, 23 and 24 exhibited little odor during and after thermal development and superior results of image tone and fog density. It was also proved that comparative sample No 13 exhibited marked odor produced during and after thermal development, leading to inferior results in either sensitivity or fog density. It was further proved that in sample of Examples 2, production of odor was largely prevented, compared to comparative sample No. 1, leading to superior results in image tone.

What is claimed is:

1. A photothermographic material comprising a support provided thereon an image forming layer containing a light sensitive silver halide, an organic silver salt and a reducing agent and at least a component a layer, wherein the component layer contains 0.2 to 5 g/m$^2$ of a compound capable of trapping a material causing odor and is provided farther from the support than the image forming layer.

2. The photothermographic material of claim 1, wherein the layer containing a compound capable of trapping a material causing odor is a protective layer.

3. The photothermographic material of claim 1, wherein a protective layer is provided on the layer containing a compound capable of trapping a material causing odor.

4. The photothermographic material of claim 1, wherein an interlayer is provided between the layer containing a compound capable of trapping a material causing odor and the image forming layer.

5. The photothermographic material of claim 1, wherein the compound capable of trapping a material causing odor is a compound capable of performing a nucleophilic addition reaction with the compound causing odor.

6. The photothermographic material of claim 5, wherein the compound capable of trapping a material causing odor is a compound having an amino bond, a urea bond, an amido bond or an imido bond in the molecule.

7. The photothermographic material of claim 6, wherein the compound having an amino bond is at least one selected from the group consisting of hexamethylenediamine, morpholine, 2-amino-4,5-dicyanoimidazole, 3-azahexane-1,6-diamine, 2-acrylamido-2-methylpropanesulfonic acid, $\alpha$-amino-caprolactam, acetoguanamine, guanine, acetoaldehyde ammonia, 4,7-diazadecane-1,10-diamine, pyrrolidine, piperidine, piperazine, polyethyleneimine, polyarylamine, polyvinylamine, and polyaniline.

8. The photothermographic material of claim 6, wherein the compound having a urea bond is at least one selected from the group consisting uera, ethylurea, dimethylurea, diethylurea, ethyleneurea, guanylurea, guanylthiourea, azodicarbonamide, glycolylurea, and acetylurea.

9. The photothermographic material of claim 6, wherein the compound having an amido bond is at least one selected from the group consisting of formamide, acetoamide, benzamide, oxamide, oxamic acid, succinic acid amide, and malonamide.

10. The photothermographic material of claim 6, wherein the compound having an imido bond is at least one selected from the group consisting succiimide, phthalimide, maleimide, 1-methylol-5,5-dimethylhydantoin, allantoin compound, isocyanuric acid, azole compounds, azine compounds, and pyridazine compounds.

11. The photothermographic material of claim 6, wherein the compound capable of trapping a material causing odor is at least one selected from the group consisting of 2-acrylamido-2-methylpropanesulfonic acid, glycol urea, succinamide, 5-dimethylhydatoin, allantoin, isocyanuric acid, 3,5-dimethyl-1-phenylpyrazole, 5-methylbenztriazole, 3-amino-5,6-dimethyl-1,2,4-triazine and 6-methyl-8-hydroxytriazolopyridazine.

12. The photothermographic material of claim 1, wherein the material causing odor is at least one selected from the group consisting of aldehydes and their alcohol adducts, formic acid, and oxalic acid.

13. The photothermographic material of claim 1, wherein the material causing odor is at least one selected from the group consisting of formaldehyde, acetoaldehyde, butylaldehyde, formic acid and oxalic acid.

14. The photothermographic material of claim 1, wherein the image forming layer further contains a binder.

15. The photothermographic material of claim 14, wherein the binder is a polyvinyl butyral.

16. A photothermographic material comprising a support provided thereon an image forming layer containing a light sensitive silver halide, an organic silver salt and a reducing agent and at least a component a layer, wherein the component layer contains a compound capable of trapping a material causing odor and is provided farther from the support than the image forming layer; said compound capable of trapping a material causing odor, which is a compound capable of performing a nucleophilic addition reaction with the compound causing odor and having an amino bond, a urea bond, an amido bond or an imido bond in the molecule is at least one selected from the group consisting of 2-acrylamido-2-methylpropanesulfonic acid, glycol urea, succinamide, 5-dimethylhydatoin, allantoin, isocyanuric acid, 3,5-dimethyl-1-phenylpyrazole, 5-methylbenztriazole, 3-amino-5,6-dimethyl-1,2,4-triazine and 6-methyl-8-hydroxytriazolopyridazine.

* * * * *